US006868561B1

(12) United States Patent
Myers

(10) Patent No.: US 6,868,561 B1
(45) Date of Patent: Mar. 22, 2005

(54) EASY ACCESS COMMODE SEAT

(76) Inventor: Dwight Myers, 165 Birchwood La., Mocksville, NC (US) 27028

( * ) Notice: Subject to any disclaimer, the term of this patent is extended or adjusted under 35 U.S.C. 154(b) by 0 days.

(21) Appl. No.: 10/735,136

(22) Filed: Dec. 12, 2003

(51) Int. Cl.[7] ..... A47K 13/12
(52) U.S. Cl. ..... 4/240; 4/237
(58) Field of Search ..... 4/234–240

(56) References Cited

U.S. PATENT DOCUMENTS

| | | | | |
|---|---|---|---|---|
| 195,514 | A | 9/1877 | Kutscher | |
| 439,797 | A | 11/1890 | Bowen | |
| 1,510,493 | A | * 10/1924 | Dillard | 4/237 |
| 2,104,714 | A | * 1/1938 | Moore | 4/240 |
| 2,228,927 | A | 1/1941 | Moore | |
| 2,266,641 | A | 12/1941 | Joyce et al. | |
| 4,877,286 | A | 10/1989 | Hobson et al. | |
| D385,341 | S | 10/1997 | Ouzounian | |
| 6,018,825 | A | 2/2000 | Enomoto | |

* cited by examiner

*Primary Examiner*—Gregory L. Huson
*Assistant Examiner*—Huyen Le
(74) *Attorney, Agent, or Firm*—Kennedy Covington Lobdell & Hickman, LLP

(57) ABSTRACT

A commode seat for selectively permitting increased manual access to a perianal region of a human seated on the seat following use of the commode includes a base plate and first and second arm plates extending from the base plate along the rim, wherein at least one of the arm plates is connected to the base plate via a hinge and is movable between a closed position at which the arm plate is aligned with the rim and an open position at which the arm plate is laterally displaced from the rim to provide an opening of substantially greater vertical dimension between the rim and a thigh or buttock of the human.

19 Claims, 3 Drawing Sheets

EASY ACCESS COMMODE SEAT

FIELD OF THE INVENTION

The present invention relates generally to a seat for a commode and more particularly to a seat having a hinged portion to allow easier access to the underside thereof.

BACKGROUND OF THE INVENTION

Throughout history humanity has sought to improve the standard facilities provided for the elimination of excretory waste so as to maintain an appropriate level of personal hygiene and personal comfort during excretion. As indoor plumbing has become virtually universally available, the flush toilet, with its familiar tank, bowl, and: seat construction, has come to be standardized into a particular configuration. Waste is deposited through an opening in the seat into the bowl, and water is released from the tank to flush the waste down a pipe into a sewer or septic system.

After excretion of waste, the common practice for purposes of good personal hygiene and social acceptance is to utilize a quantity of soft paper tissue to remove any waste remaining in the perianal area by shifting one's weight to one side, lifting the other side from the seat, and reaching, tissue in hand, to the perianeum.

For a person of average agility and strength, this process is accomplished most easily. However, a number of factors, many of which are seen in increasing numbers of the population, may make the wiping process more difficult. For example, obesity, the frailty of old age, or a physical handicap may cause the person varying degrees of difficulty in accomplishing the required task. For persons in such a position, the possibility of debilitating injury or severe discomfort while attempting to accomplish this particular life function is an invitation to disregard good personal hygiene. If the condition is severe enough, then the assistance of another person may be required to perform what for most people is among the most private and personal actions they take in their entire lives.

The difference between being able to live without the assistance of others and needing comprehensive and embarrassing personal care help often can be measured by minor details of living. For example, a person who is confined to a wheelchair might be able to be self-sufficient by modifying that person's home by, for instance, eliminating steps at entranceways, thresholds, and narrow spaces. In the context of the present invention, much of the problem arises from the fact that the hand must be inserted into a relatively small space, the size of which is defined by the person's ability to create it by sitting awkwardly. This is largely a function of conventional toilet design.

What is needed is a toilet seat that permits easier access to the person's underside, in order to maximize the opportunity for good personal hygiene.

SUMMARY OF THE INVENTION

In accordance with the above-mentioned needs, the present invention includes a commode seat which differs from conventional seats primarily in that a portion of each side of the seat is hinged to allow it to rotate out of the way, thereby allowing for a larger opening between the rim of the toilet bowl and the thigh or buttock of the person seated on the commode.

A commode seat according to the present invention selectively permits increased manual access to a perianal region of a human seated thereon following use of the commode. The seat includes a base plate that is hingedly connected to a rear portion of a rim of a bowl of the commode. First and second arm plates extend from the base plate along the rim to form a seat that visually approximates the appearance of a conventional commode seat.

At least one of the arm plates is connected to the base plate via a hinge and is movable between a closed position, at which the arm plate is aligned with the rim, and an open position, at which the arm plate is laterally displaced from the rim. In the open position, the seat provides an opening of substantially greater vertical dimension between the rim and a thigh or buttock of the human.

In alternative embodiments of the present invention, the hinge connecting the base plate to the arm plate may be either a disk hinge or a post hinge, although any suitably configured hinge may be used without departing from the scope of the invention.

In a further feature of the present invention, when a disk hinge is used, the base plate includes at the interface with the arm plate a portion of a substantially thinner profile extending under a complementary portion of the arm plate, such that the interface therebetween is horizontal. A disk hinge includes a vertical post fixedly molded into the base plate in the thinner portion and extending into a recess in the arm plate. This post provides a mounting location for a pair of generally circular disks, which are rotatably mounted concentrically upon the post and disposed in mutually facing relation.

In this arrangement one of the disks is assigned to the base plate and the other to the arm plate, and the disks may be molded into their respective plates. In order to provide additional strength and support at the connection point, each of the disks may further include at least one supporting member extending into the plate to which the disk is attached. These supporting members may take the form of an oblong portion extending into the thicker-profiled section of the plate, or a series of tabs extending circumferentially from the disks, or both.

In another feature of the present invention, one of the disks includes at least one ridge extending from the disk toward the other disk, and the other disk includes a complementary detent that is aligned with the ridge when the arm plate is in the closed position and misaligned with the ridge when the arm plate is in the open position. This ridge and detent system may take a wide variety of configurations and helps to prevent the arm plate from moving to the open position at an undesirable time.

The disk hinge may also include a spring which is biased to urge the disks together. This spring may be of any suitable type, although a spring washer is preferred for ease of design.

In another feature of the present invention, the vertical post of the disk hinge may be either a bolt and a nut or a pin and compression nut.

In addition to the aforementioned features, the commode seat of the present invention may further include a foot that extends from an underside portion of one of the arm plates, at a point distant from the base plate, to support the arm plate upon the rim. Although conventional toilet seats are commonly provided with feet to allow for safe support of the seat upon the rim, such feet are configured to provide only vertical support. In the present invention, the foot or feet are preferably configured to provide both vertical support (as in conventional systems) and lateral support (so as to inhibit unwanted movement of the arm plate from the closed to the open position). Ideally a second foot disposed at the hinge will provide additional vertical support.

In order to facilitate moving the arm plate from the closed to the open position, the seat may be provided on an underside portion of the arm plate with a gripping location, which in a preferred embodiment is simply a recess molded into the arm plate.

In yet another feature of the present invention, the connection between the base plate and the arm plate is configured to inhibit pinching when the arm plate is moved from the open position to the closed position, such as by beveling the edge or by providing a cover for the connection.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
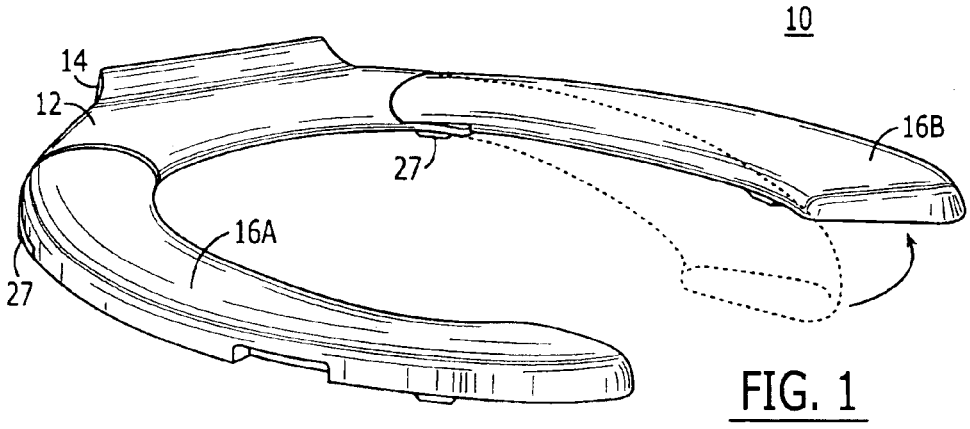
FIG. 1 is a general perspective view of a commode seat according to the present invention.

Referring now to the drawings, a commode seat 10 according to the present invention is shown in a general perspective view in FIG. 1. At the outset it should be noted that while a seat having an open front, as shown, is preferred for reasons of simplicity of design, it is equally possible to have a seat with a closed front, if desired for aesthetic reasons, without departing from the scope of the present invention. This may be accomplished simply by having a disconnectable connection between the two arm plates at the front of the seat, in a manner which will become clear in the context of the discussion below.

The embodiment shown in FIG. 1 includes a commode seat 10 that includes a base plate 12 which serves as the main connection between the seat 10 and the commode (not shown). Various means for connecting the seat 10 to the commode are well known in the art, with likely the most commercially common means being a simple horizontal post hinge serving to allow the seat to be raised or lowered as needed. Regardless, the particular means by which the seat 10 is connected to the commode will depend largely on the configuration of the commode and forms no part of the present invention. In the embodiment shown in FIG. 1, the base plate simply includes a tube 14 through which a post hinge may be inserted. Other than that connection, the seat 10 is generally not fixed to the commode. Particularly for home use, a coordinated seat cover or lid (not shown), connected to the commode in a conventional manner unrelated to the scope of the present invention, may prove to be commercially desirable.

A pair of arm plates 16A,16B extend from the base plate 12, generally following (when the arm plate 16B is position as shown in phantom) the contour of a typical commode bowl rim (not shown) to form the seat 10. For reasons of comfort and the most expedient use of the commode, the seat 10 may be provided with a contour that generally slopes toward the interior of the seat 10.

The seat 10 is preferably molded from plastic which is of a sufficiently high strength to withstand significant amounts of weight applied thereto. Because one of the principal aims of the present invention is to provide a commode seat in which access for wiping is improved, those skilled in the art will recognize that a seat 10 of a substantially thicker vertical dimension than a conventional seat will provide greater access. Preferably the seat 10 will be at least twice as thick as a conventional seat, which also aids in the durability of the seat 10 under substantially higher loads based upon the weight of the person using the seat 10 and the novel construction of the seat 10.

Each of the arm plates 16 is connected to the base plate 12 via a hinge system (see, e.g., FIG. 3A) which permits the arm plate 16 to be selectively rotated outward, at which point the arm plate 16 no longer obstructs access to the perianal area of the user. This results in an opening of substantially greater vertical dimension between the rim and the thigh or buttock of the user.

Figure 2:
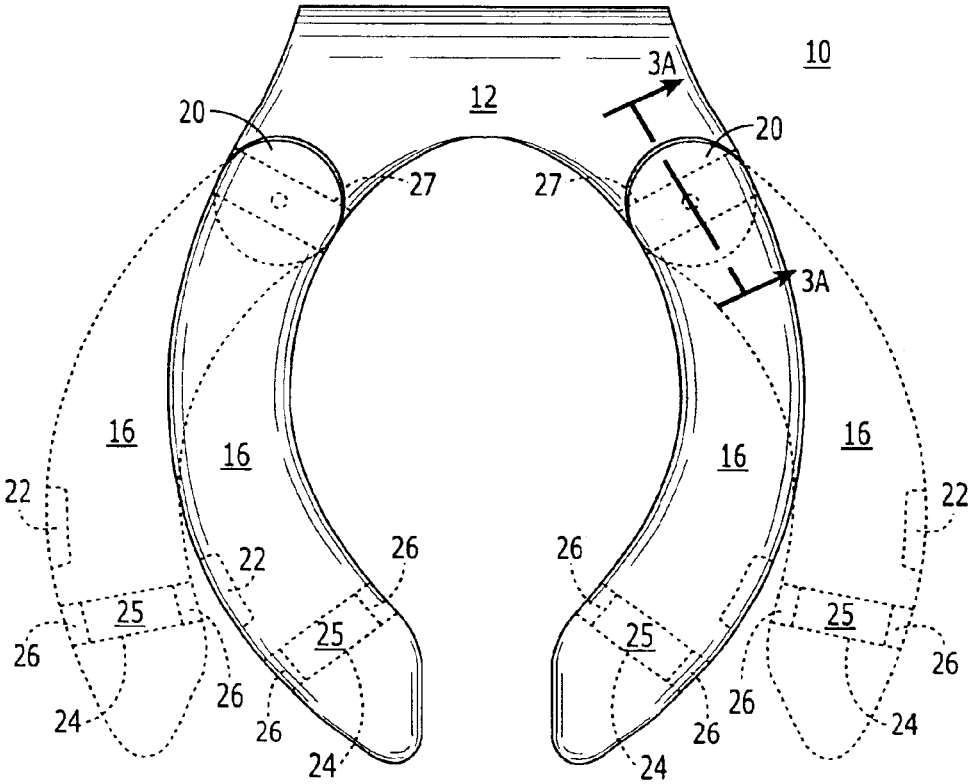
FIG. 2 is a plan view of a commode seat according to the present invention.

Referring now to FIG. 2, a preferred embodiment of the present invention is shown in a plan view. A base plate 12 and two arm plates 16 form a commode seat 10. In a preferred embodiment, the arm plates 16 are connected to the base plate 12 via a hinge system 20 which is preferably a disk hinge. The construction of the disk hinge 20 will be discussed in greater detail below.

As can be seen in FIG. 2, the disk hinges 20 allow the arm plates 16 to move between a closed position (indicated by solid lines) and an open position (indicated by phantom lines). In the closed position, the commode seat 10 of the present invention mimics a conventional seat. In the open position, however, the arm plate 16 no longer obstructs access underneath the user. Those skilled in the art will easily recognize that at most only one of the arm plates 16 will be in the open position at a time, since the other arm plate 16 is needed to support the weight of the user. Indeed, it is equally possible to provide a seat 10 in which only one of the arm plates 16 is movable, the other being fixed in place or forming part of the base plate 12.

Also visible in phantom in FIG. 2 are two additional features of the present invention. The first is a gripping location 22, which is disposed on the underside of each of the arm plates 16 and which provides a point where the user may easily grip the arm plate 16 to dislodge it from the closed position. The second additional feature is a foot 24, also disposed on the underside of each of the arm plates 16. In conventional systems, the seat is provided with a foot that is generally flat so as to provide a vertical cushion between the seat and the rim of the bowl. This foot serves to support the seat, but it also saves wear and tear on the seat and the bowl by cushioning the seat if it is banged upon the bowl.

In the present invention, it is desirable to prevent both undesired banging as the seat 10 is lowered onto the bowl and lateral movement of the arm plates 16 from the closed position at an inopportune time. Thus, the foot 24 in the present invention is configured with a vertical supporting member 25 and a pair of lateral supporting members 26. The lateral supporting members 26 are preferably spaced apart by approximately the width of the rim of the bowl and have a slightly thicker profile than the vertical supporting member 25. For that reason, the foot 24 provides both vertical and lateral support for the arm plate 16 and discourages undesired movement of the arm plate 16 out of the closed position. Because this foot 24 raises the seat at the distal end of the arm plates 16, it is advisable to have a second foot 27 disposed on the underside of the base plate 12 under the hinge 20, so as to provide appropriate support to a location where stress is the greatest. The foot 27 may be flat (in comparison to the foot 24) or any other appropriate shape. Any number of additional feet (not shown) might be placed along the underside of the arm plates 16 depending upon the amount of support required, without departing from the scope of the invention.

Figure 3A:
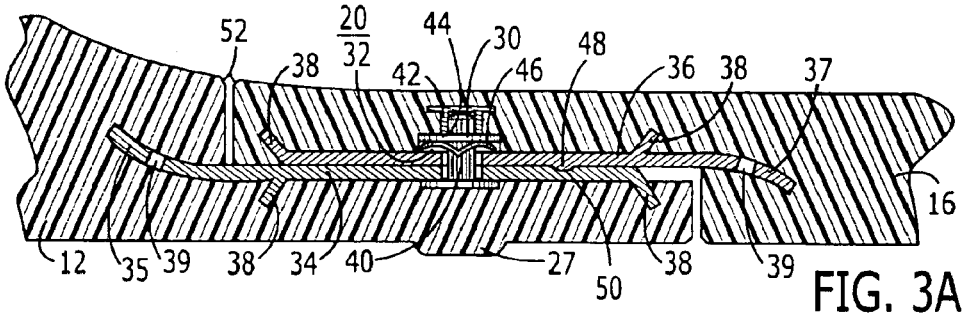
FIGS. 3A and 3B are cross-sectional views of a disk hinge configuration according to the present invention, taken along line 3A—3A in FIG. 2.

The nature of the preferred connection between the base plate 12 and the arm plates 16 is shown in greater detail in FIG. 3A. FIG. 3A is a cross-sectional view of a hinge system 20, taken along line 3A—3A in FIG. 2. In a preferred embodiment the disk hinge 20 includes a post 30 which is fixedly molded into the base plate 12 and which extends into a recess 32 in the arm plate. A pair of generally circular disks 34,36 are rotatably mounted concentrically upon the post 30 and are disposed in mutually facing relation. Disk 34 is preferably molded into the base plate 12 and disk 36 is preferably molded into the arm plate 16. The disks 34,36 are preferably made of stainless steel or another suitable material and may be lubricated on their facing portions.

In order to improve the retention of the disks 34,36 within their respective plates 12,16, and to provide support for the connection between the base plate 12 and the arm plate 16, one or more supporting members that extend into the seat may be provided. In a preferred embodiment, these supporting members include an oblong portion 35,37 formed integrally with the disks 34,36 which extends outward from a location on the circumference of the disks 34,36 to provide for additional support for weight placed upon the arm plate 16, particularly when the arm plate is in the open position. Because the profiles of the base plate 12 and the arm plate 16 are substantially thicker outside the connection region, the oblong portions 35,37 preferably deflect into the plates 12,16 so as to be more centrally located within the plates 12,16.

Additionally, the disks 34,36 may be provided with another class of supporting members which include a series of circumferentially spaced tabs 38 which extend from the disks 34,36 in the direction facing away from the other disks. These tabs serve to improve the retention of the disks 34,36 within the plates 12,16.

As can be seen in FIG. 3A, in order to facilitate the use of a disk hinge 20, it is necessary at the connection location to stack the arm plate 16 upon the base plate 12. Consequently, in order to maintain a comfortable seat profile, it is necessary to configure the base plate 12 to have a substantially thinner profile in the connection region, preferably about half-height, and to configure the arm plate 16 to be complementarily thinner in the connection region. Because the individual thickness of the plates 12,16 is reduced in this region, reinforcement as described above is particularly useful. Moreover, those skilled in the art will recognize that providing for a general thickness of the seat 10 which is at least double that utilized in a conventional seat is preferable.

In the embodiment shown in FIG. 3A, the post 30 includes a pin 40 and a compression nut 42. In such a system, the central holes in the disks 34,36 are preferably sized so as to receive within them not only the pin 40 but also the compression nut 42, which is during assembly pushed down through the disks 34,36. The system is also provided with appropriate washers 44 and may be provided with a spring washer 46 (or another suitable biasing device) to urge the disks into mutual contact.

Figure 3B:
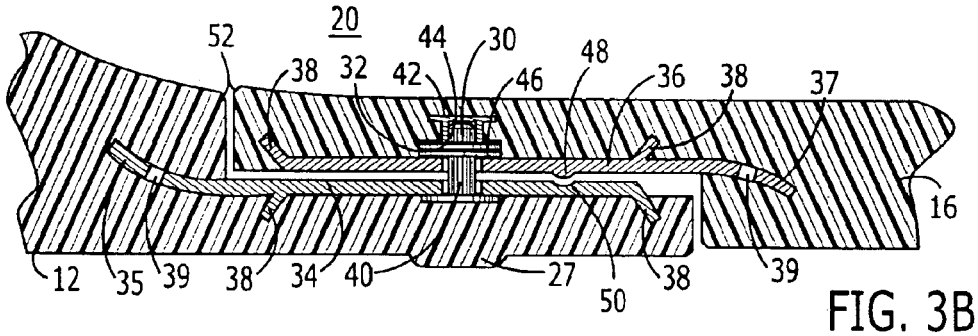

In order to assist in retaining the arm plate 16 in the closed position wherever it is desirable to do so, one of the disks 34,36 (as shown, disk 36) is provided with at least one ridge 48 extending from the disk toward the other disk (as shown, disk 34). The other disk (as shown, disk 34) includes a complementary detent 50 that is aligned with the ridge 48 when the arm plate 16 is in the closed position. In FIG. 3B, a view similar to that shown in FIG. 3A is shown, except that the arm plate 16 is in the open position. As can be seen in FIG. 3B, the ridge 48 forces a slight separation between the disks 34,36 to facilitate easier movement to the open position. The spring washer 46 is therefore loaded, such that when the arm plate 16 is returned to the closed position, the spring washer 46 will again urge the disks 34,36 into contact.

Also visible in FIGS. 3A and 3B is an anti-pinching feature of the preferred embodiment. The edges of the upper portions of the arm plate 16 and the base plate 12 are provided with bevels 52 to inhibit pinching of the skin between the base plate 12 and the arm plate 16 as the arm plate 16 is returned to the closed position.

Figure 4:
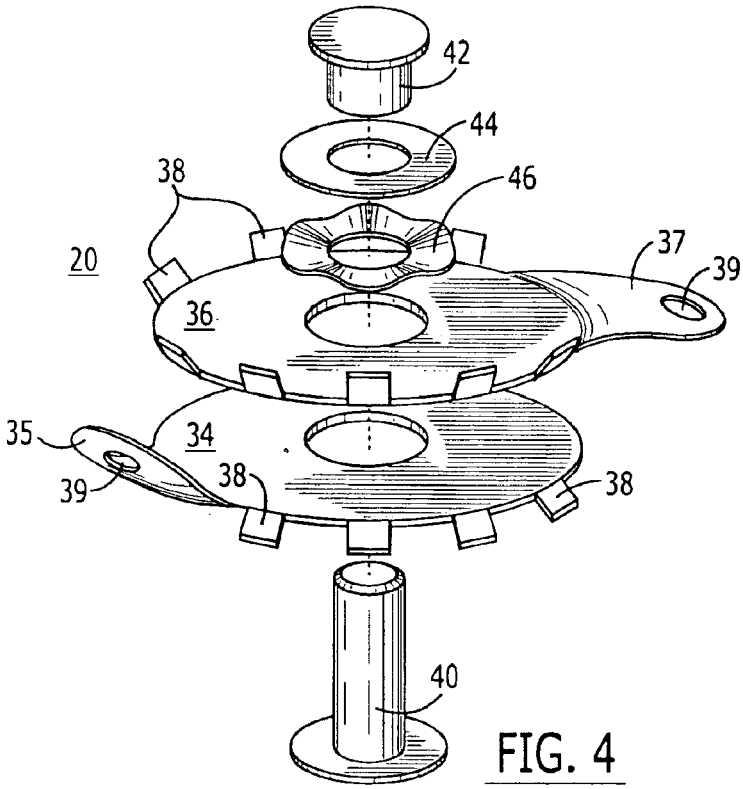
FIG. 4 is a perspective view of a disk hinge according to the present invention, with component parts in exploded relation.
Figure 5:
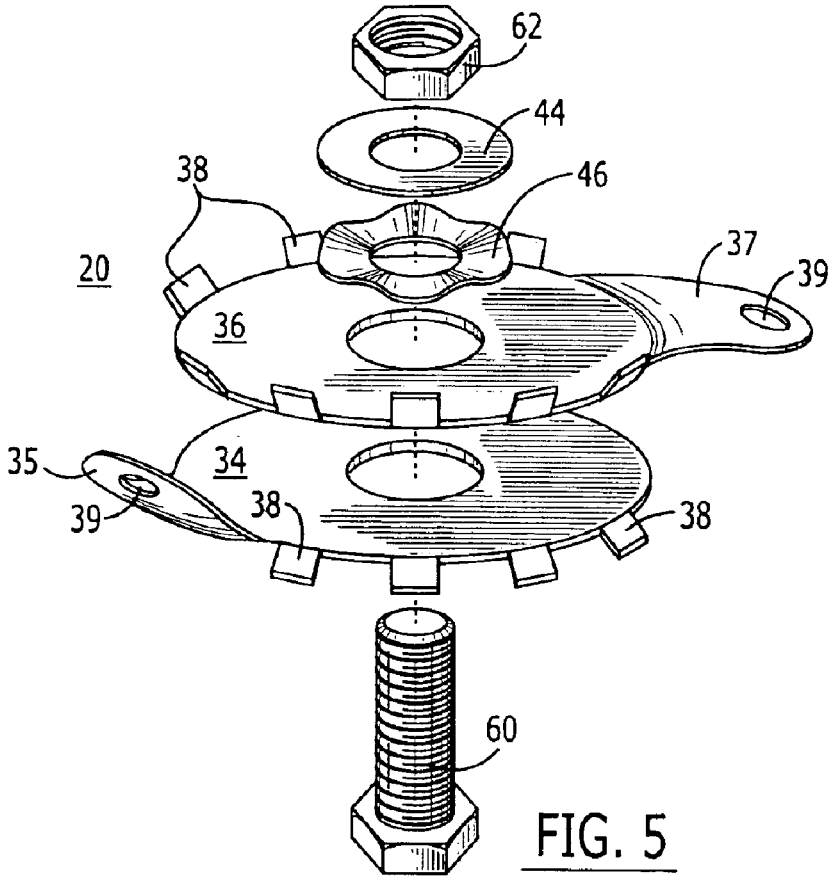
FIG. 5 is a perspective view as in FIG. 4 according to an alternative embodiment of the present invention.

Referring now also to FIGS. 4 and 5, the component parts of the disk hinge 20 are shown in exploded relation for greater clarity of detail as described above. In FIG. 4, the post 30 includes a pin 40 and a compression nut 42, with the openings in the washers 44,46 and the disks 34,36 sized to receive the compression nut 42. In order to keep the washers 44,46 in tight relation to the disks 34,36, the compression nut 42 is provided with a shoulder 43. In the alternative embodiment shown in FIG. 5, the post 30 is a threaded bolt 60 and nut 62.

As can also be seen in FIGS. 4–5, the oblong portions 35,37 are provided with one or more holes 39. As these oblong portions 35,37 are molded into the plastic of the seat 10, plastic will flow into the holes 39 and harden, providing for additional strength and intractability of the connection between the oblong portions 35,37 and the seat 10.

Figure 6:
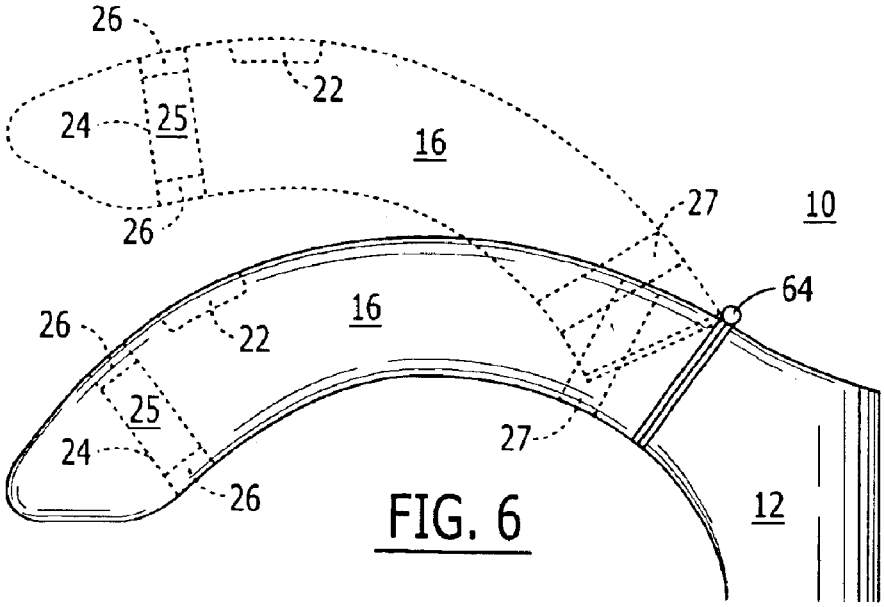
FIG. 6 is a partial plan view of an alternative embodiment of the present invention.

Referring now to FIG. 6, an alternative hinging system for the seat 10 is shown. Instead of a disk hinge 20 as shown in FIG. 2, the interface between the arm plate 16 and the base plate 12 is flat and vertical, and the plates 12,16 are connected via a post hinge 64. This arrangement allows for a potentially greater displacement between the closed position and the open position and offers the advantage of a greater simplicity of working parts than the disk hinge embodiment. One or more additional feet 27 are preferably provided in the region of the post hinge 64, in order to provide vertical support for the seat 10.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention.

The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A commode seat for selectively permitting increased manual access to a perianal region of a human seated thereon following use of said commode, comprising:

a base plate hingedly connected to a rear portion of a rim of a bowl of the commode; and first and second arm plates extending from the base plate along the rim;

wherein at least one of the arm plates is connected to the base plate via a hinge and is movable independently of the other of the arm plates between a closed position at which the one of the arm plates is aligned with the rim and an open position at which the one of the arm plates is laterally displaced from the rim to provide an opening of substantially greater vertical dimension between the rim and a thigh or buttock of the human.

2. A commode seat according to claim 1, wherein the hinge is a disk hinge.

3. A commode seat according to claim 2, wherein the disk hinge comprises:

a post fixedly molded into the base plate and extending into a recess in the one of the arm plates; and a pair of generally circular disks rotatably mounted concentrically upon the post and disposed in mutually facing relation.

4. A commode seat according to claim 3, wherein one of the disks is molded into the base plate and the other of the disks is molded into the one of the arm plates.

5. A commode seat according to claim 4, wherein each of the disks further comprises at least one supporting member extending into the seat.

6. A commode seat according to claim 4, wherein one of the disks comprises at least one ridge extending therefrom toward the other of the disks, and the other of the disks comprises a complementary detent aligned with the ridge when the one of the arm plates is in the closed position.

7. A commode seat according to claim 3, wherein the disk hinge further comprises a spring biased to urge the disks together.

8. A commode seat according to claim 3, wherein the post comprises a bolt and a nut.

9. A commode seat according to claim 1, further comprising a foot extending from an underside portion of one of the arm plates at a distal end thereof in vertical and lateral supporting relation thereto upon the rim.

10. A commode seat according to claim 1, further comprising a gripping location disposed on an underside portion of at least one of the arm plates.

11. A commode seat according to claim 1, wherein the hinge is a post hinge.

12. A commode seat according to claim 1, wherein the connection between the base plate and the one of the arm plates is configured to inhibit pinching when the arm plate is moved from the open position to the closed position.

13. A commode seat for selectively permitting increased manual access to a perianal region of a human seated thereon following use of said commode, comprising:

a base plate hingedly connected to a rear portion of a rim of a bowl of the commode; and first and second arm plates extending from the base plate along the rim;

wherein at least one of the arm plates is connected to the base plate via a disk hinge and is movable between a closed position at which the one of the arm plates is aligned with the rim and an open position at which the one of the arm plates is laterally displaced from the rim to provide an opening of substantially greater vertical dimension between the rim and a thigh or buttock of the human, and wherein the disk hinge comprises:

a post fixedly molded into the base plate and extending into a recess in the one of the arm plates; and a pair of generally circular disks rotatably mounted concentrically upon the post and disposed in mutually facing relation.

14. A commode seat according to claim 13, wherein one of the disks is molded into the base plate and the other of the disks is molded into the one of the arm plates.

15. A commode seat according to claim 14, wherein each of the disks further comprises at least one supporting member extending into the seat.

16. A commode seat according to claim 14, wherein one of the disks comprises at least one ridge extending therefrom toward the other of the disks, and the other of the disks comprises a complementary detent aligned with the ridge when the one of the arm plates is in the closed position.

17. A commode seat according to claim 13, wherein the disk hinge further comprises a spring biased to urge the disks together.

18. A commode seat according to claim 13, wherein the post comprises a bolt and a nut.

19. A commode seat for selectively permitting increased manual access to a perianal region of a human seated thereon following use of said commode, comprising:

a base plate hingedly connected to a rear portion of a rim of a bowl of the commode; and first and second arm plates extending from the base plate along the rim;

wherein each of the arm plates is connected to the base plate via a respective hinge such that each arm plate is movable independently of the other of the arm plates between a closed position at which the one of the arm plates is aligned with the rim and an open position at which the one of the arm plates is laterally displaced from the rim to provide an opening of substantially greater vertical dimension between the rim and a thigh or buttock of the human.

* * * * *